United States Patent [19]

D'Amico

[11] Patent Number: 4,976,641

[45] Date of Patent: Dec. 11, 1990

[54] BUOY WITH SELF-EJECTING WEIGHT

[76] Inventor: Dennis D'Amico, 2073 64th Ave. S., St. Petersburg, Fla. 33712

[21] Appl. No.: 491,031

[22] Filed: Mar. 9, 1990

Related U.S. Application Data

[63] Continuation-in-part of Ser. No. 347,256, May 5, 1989, abandoned.

[51] Int. Cl.[5] ..... B63H 22/18

[52] U.S. Cl. ..... 441/023; 441/6

[58] Field of Search ..... 441/6, 7, 21–28; 116/107

[56] References Cited

U.S. PATENT DOCUMENTS

| | | | |
|---|---|---|---|
| 2,562,922 | 8/1951 | Kist | 441/6 |
| 3,441,962 | 5/1969 | Williams | 441/25 X |
| 3,653,085 | 4/1972 | Rovner | 441/23 X |
| 4,074,380 | 2/1978 | Parker | 441/26 |

*Primary Examiner*—Sherman Basinger
*Assistant Examiner*—Edwin L. Swinehart
*Attorney, Agent, or Firm*—Stanley M. Miller

[57] ABSTRACT

A surface buoy. The buoy includes top and bottom flotation members of hemispherical configuration and a reel member positioned between them. An elongate flexible cord is coiled about the reel member and has a first end secured thereto. A second end of the cord is secured to a weight member. The top flotation member has a nest-like recess formed therein into which the weight member is positioned when the buoy is not in use. When the buoy is tossed into a body of water, the bobbing action of the buoy throws the weight out of its nest and into the water. As the weight sinks, it uncoils the cord from the reel member until it reaches the bottom of the body of water, at which time further uncoiling of the cord stops.

30 Claims, 2 Drawing Sheets

BUOY WITH SELF-EJECTING WEIGHT

CROSS-REFERENCE TO RELATED APPLICATIONS

This disclosure is a continuation-in-part of a copending application Ser. No. 347,256 filed by the same inventor on May 5, 1989, entitled "Buoy With Self-Ejecting Weight" now abandoned.

BACKGROUND OF THE INVENTION

1. Field of the Invention

This invention relates, generally, to buoys. More particularly, it relates to a buoy having a nested weight that ejects itself from its nest when the buoy hits the water.

2. Description of the Prior Art

Buoys are flotation devices that have utility in many different contexts. For example, a diver may carry a buoy during a dive, and release it to mark a location when it floats to the surface. In other applications, a buoy may be released from a surface vessel to mark a channel or other location.

U.S. Pat. No. 4,074,380 to Parker shows a recovery buoy of the type carried by a diver for subsequent release. It includes a body having a reel area around which an elongate cord is wound; a weight is attached to the end of the cord and cancels out the buoyancy of the device while the diver is transporting the buoy under water. When the diver desires to mark the location of an under water structure or other under water point of interest, the weight is secured to the structure and the buoy is released so that it floats to the surface. The cord unwinds as the buoy rises.

Thus, buoys having flexible elongate cords coiled thereabout are known, but buoys having self-ejecting weights do not appear in the prior art. More importantly, the art does not suggest how a self-ejecting weight means could be provided.

SUMMARY OF THE INVENTION

The present invention provides a buoy that is tossed into the sea or other body of water from a boat and which has a weight means that ejects itself from a weight nest formed in the buoy when the buoy bobs in the water.

More specifically, in a first embodiment the buoy includes top and bottom hemispherical in configuration flotation members; the top flotation member has a nest area formed therein into which the weight member is stored when the buoy is not in use. A nylon rope has a first end secured to the weight and a second end secured to a reel area of the buoy. When the buoy is tossed into the water, the initial bob of the buoy in the water throws the weight out of its nest; the cord unreels as the weight sinks.

In a second embodiment, the top and bottom flotation members and the reel area are integrally formed with one another and the buoy is formed in two halves to facilitate its manufacture.

It is therefore understood that the primary object of this invention is to advance the art of buoy constructions in general.

A more specific object is to provide a surface buoy that in effect positions itself with minimal human intervention by employing a weight means that sinks into the water as soon as the buoy is tossed into a body of water.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

DETAILED DESCRIPTION OF THE PREFERRED EMBODIMENT

Figure 1:
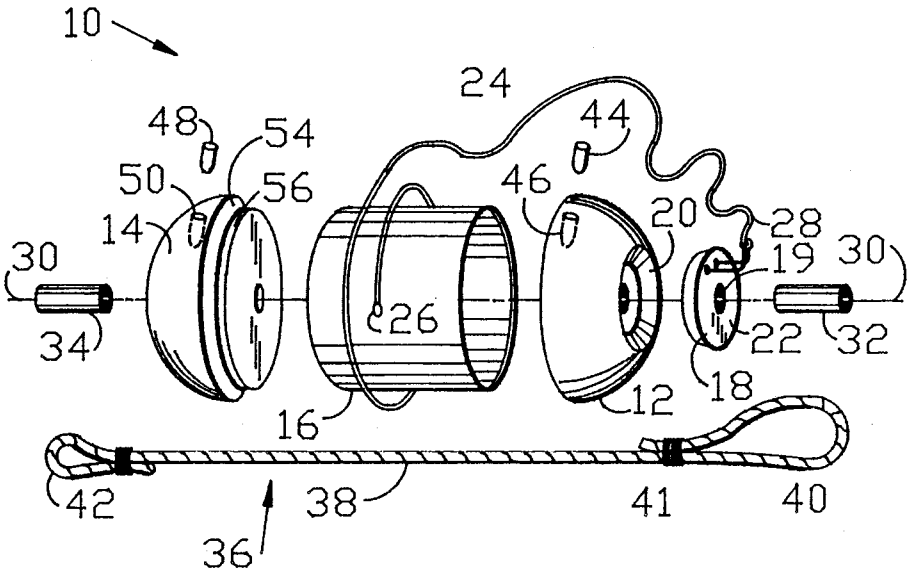
FIG. 1 is an exploded perspective view of a first embodiment of the invention.

Referring now to FIG. 1, it will there be seen that an illustrative embodiment of the invention is denoted by the reference numeral 10 as a whole.

The buoy includes a first or top hemispherical in configuration flotation member 12, a second or bottom hemispherical in configuration flotation member 14, and a cylindrical reel member 16 disposed in sandwiched relation therebetween.

A toroidal in configuration weight member 18, formed preferably of lead, is loosely received, when the buoy is assembled, within a circular weight nest 20 formed in top flotation member 12.

Figure 2:
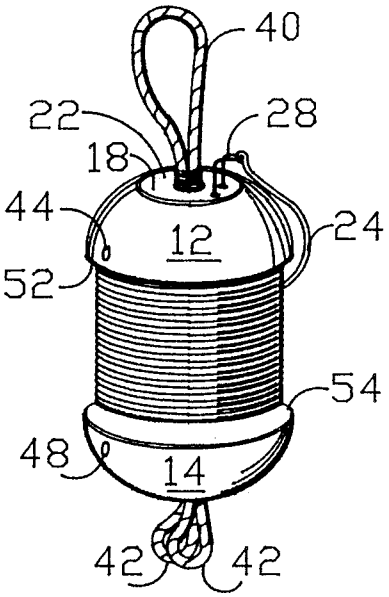
FIG. 2 is a perspective view of the embodiment of FIG. 1 in its assembled configuration.

Nest 20 has a predetermined depth substantially equal to the thickness of the weight member 18 so that the flat top surface 22 of weight member 18 lies flush with the top surface of the top flotation member 12 when the buoy is assembled as shown in FIG. 2.

An elongate nylon bungee cord 24 has a first end fixedly secured to reel member 16 of the buoy as at 26 and a second end fixedly secured to a cord clip 28. Cord clip 28 is fixedly secured to lead weight 18.

When the inventive structure 10 is assembled, bungee cord 24 is coiled around reel member 16 in the manner depicted in FIG. 2; importantly, when the cord has been fully coiled about reel 16, weight member 18 can be rotated in a clockwise direction to tighten the coil if the coil was formed in a clockwise rotation, and can be rotated within nest 20 in a counterclockwise direction to tighten the cord 24 if it is coiled about reel 16 in a counterclockwise direction., as should be clear from FIG. 2.

When weight 18 is displaced from its nest 20, it will sink in water and uncoil cord 24 from reel 16 until the weight hits the bottom of the water, at which time further uncoiling of cord 16 will stop.

Weight 18 and the hemispherical flotation members 12 and 14 are centrally bored, i.e., a bore is formed coincident with their common longitudinal axis of symmetry 30 as clearly shown in FIG. 1. A plastic dowel member 32 of cylindrical configuration is axially received within the central bore of weight member 18 and the bore means formed in top flotation member 12 when buoy 10 is assembled, and a similar cylindrical plastic dowel member 34 is slideably received within the bore formed in the bottom flotation member 34 when the device is assembled.

Nylon rope 36, having a medial part 38, a top loop 40 and a bottom double loop 42, is slideably received within the bore means formed in the top and bottom flotation members 12 and 14 and the weight member 18; as shown in FIG. 2, top loop 40 has a greater extent than bottom loop 42 and serves as a handle means for the buoy 10 and bottom double loop 42 helps maintain the parts in their assembled configuration. The size or width of bottom loop 42 prevents its retraction into the second bore means formed in the bottom flotation member 14 but the base 41 of top loop 40 is slideably received within the bore means formed in top flotation member 12.

Plastic dowel members 32, 34, help prevent abrasion of the top and bottom flotation members 12 and 14, which are made of styrofoam, by the rope 36; top dowel 32 also prevents abrasion of rope 36 by weight member 18.

A top counterweight 44 is fixedly positioned within a cavity means 46 formed within the top flotation member 12 and a bottom counterweight 48 is fixedly positioned within a cavity means 50 formed in bottom flotation member 14.

It should also be noted, as a matter of structural detail, that both the top and bottom flotation members 12 and 14 include a beveled annular rim 52 and 54, respectively. Moreover, each member includes an annular rim 56, seen in FIG. 1 on bottom member 14, that is press fit into the inner cylindrical wall of reel member 16 to help maintain the interconnection of the top and bottom flotation members 12, 14 to central reel member 16.

To use the novel buoy member 10, there is no need whatsoever to uncoil cord 24 or to handle weight member 18. The device is used simply by depositing it onto the surface of a body of water by grasping top loop 40 of rope 36 and tossing the device into the water.

Upon impact with the water, counterweights 44, 48 and weight member 18 will cause the buoy 10 to momentarily sink at least partially into the water, the depth of the sinking depending upon the height of the buoy's trajectory as it was tossed. However, the high buoyancy of the styrofoam top and bottom flotation members 12 and 14, respectively, will cause the buoy to bob up quickly; the momentum generated by the quick, upwardly directed bobbing action will throw weight member 18 into the body of water because it is loosely nested within its nest 20 as mentioned earlier.

The weight 18, which is preferably about two pounds in weight, will sink at a rate of about seventeen feet per second until it reaches the bottom of the body of water and no further uncoiling of cord 24 will thereafter occur. It holds the buoy 10 against drag and drift in all but the strongest currents.

Loop 40 of nylon rope 36 does not impede weight 18 from popping from its nest 20 when the buoy 10 bobs in the water upon entry thereinto, as earlier mentioned; moreover, since rope 36 is itself buoyant, buoy 10 is easily retrieved by grasping top loop 40 as it floats upon the surface of the water.

The double bottom loop 42 provides an interesting drift detector for use in strong current areas. Fifteen feet of line is aligned in the direction of the strong current and is passed through the double loop and connected to a second flotation device. The initial position of the second line relative to the double loop 42 is noted and changes in said position thereafter indicate the amount of current-caused drift of buoy 10.

Figures 3, 4:
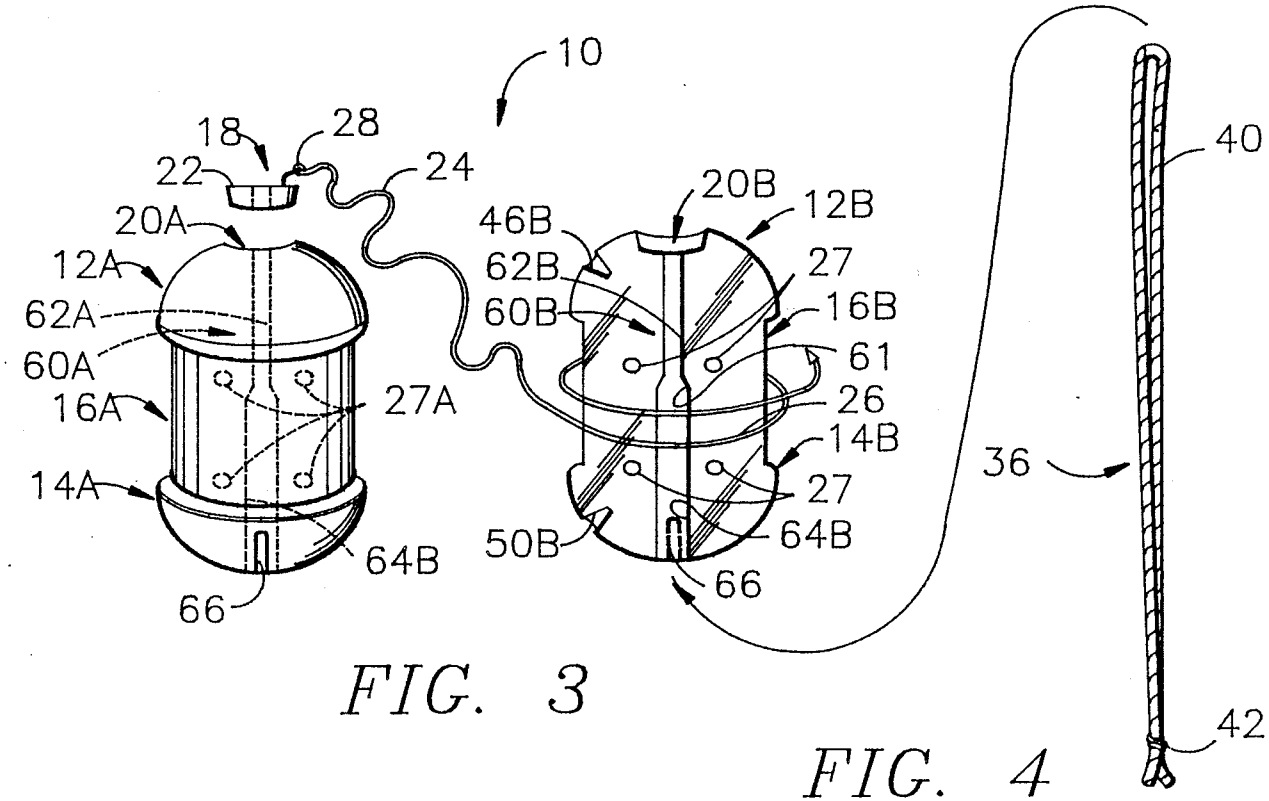
FIG. 3 is an exploded perspective view of a second embodiment of the invention.
FIG. 4 is a perspective view of a second embodiment of the rope used as a handle in connection with the second embodiment.

A second embodiment of the novel buoy is shown in FIG. 3. There it will be observed that the three individual or separate part construction (top part 12, bottom part 14, and reel 16) of the first embodiment is not employed in the second embodiment; the parts are integrally formed in this second embodiment and thus form a single unit. However, the buoy is divided into two half parts along the common longitudinal axis of symmetry of the parts; thus the separate halves exhibit bilateral symmetry. In FIG. 3, the letter "A" after a reference numeral indicates that the part corresponds to the part of the same number in the first embodiment, but to only a half part thereof, and the letter "B" indicates the second half of the same part. For example, the separate halves of the reel are denoted 16A and 16B in FIG. 3. Those skilled in the art of molding will appreciate that the buoy 10 can be made more economically when so constructed.

This second embodiment includes plural alignment pins, collectively denoted 27, that have no counterpart in the first embodiment; the pins 27 project upwardly from a preselected half part and are snugly, slideably received within corresponding recesses 27A formed in juxtaposition therewith on the opposing half part, and perform the function their name implies.

Cylinders 32 and 34 of the first embodiment are obviated in this second embodiment because the buoy is molded of a rigid, substantially indestructable plastic. In the alternative, the buoy may be molded of a preselected polystyrene or a mixture of polystyrenes or other suitable materials and protected against abrasion with a hard coating. Either way, the protective cylinders 32, 34 are not needed in this embodiment.

The rope 36 of the first embodiment is also not employed in this second embodiment. The rope of the second embodiment is also denoted 36, but is seen in FIG. 4 to consist of an elongate flexible rope having a single return bend formed therein about mid-length thereof as at 40, and having its opposite ends tied together to form a single large knot 42. The simplicity of this rope 36 contrasts with the more complex rope 36 of the first embodiment.

A central bore 60, formed when half grooves 60A, 60B are positioned in confronting relation to one another, i.e., when the buoy is assembled, includes a first bore of small diameter 62 formed from half grooves 62A and 62B, and a second bore of larger diameter 64, formed when half parts 64A and 64B are placed together; central bore 60 is coincident with the longitudinal axis of symmetry of the buoy as should be clear from the drawings. Rope 36 is positioned with bore 60 before the two half parts of the buoy are joined together, with loop 40 extending out of bore 62, and with knot 42 being disposed within bore 64. Knot 42 cannot enter into bore 62 because of the reduced diameter thereof, thereby facilitating the carrying of the novel buoy by handle 40. In other words, annular shoulder 61 prevents knot 42 from entering into the reduced diameter first part of central bore 60.

When handle 40 is not in use, it may be pressed snugly into groove 66 (bottom of FIG. 3) formed on the exterior surface of parts 14A, 14B. Groove 66 has a medial part that passes through the longitudinal axis of symmetry of the buoy and said groove has an arcuate configuration since it is formed on hemispherically-shaped part 14, i.e., about half of the groove is formed on part 14A and about half on the part 14B.

Whereas bungee cord 24 was secured to reel 16 at point 26 in the first embodiment, there is no need to so secure the bungee cord 24 in this second embodiment. All that needs to be done is to simply pass the free end thereof (the end not connected to weight 18) between the two separate halves of the buoy before they are interconnected. The rope 36 in central bore 60 will press against said cord 24 and firmly retain it in sandwiched relation between the two halves when the two halves are pressed together.

The sockets 46 and 50 for counterweights 44 and 48 are shown in this second embodiment, but their use is optional. Predetermined lengths of anchor line could be used instead.

As in the first embodiment, weight 18 loosely fits in its nest 20A, 20B that collectively form nest 20 when the buoy is assembled, and the weight is self-ejecting from said nest when the buoy bobs in the water.

Both embodiments of the buoy that have been disclosed are of simple yet elegant construction; this buoy is the first weight-ejecting buoy ever known, anywhere in the world, and for this reason it pioneers the art of weight-ejecting buoys. Thus, the claims that follow are entitled to broad interpretation, as a matter of law.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A buoy, comprising:

a first buoyant flotation member;

a second buoyant flotation member;

a reel member disposed in sandwiched relation between said first and second flotation members;

means for maintaining said first and second flotation members in sandwiching relation to said reel member;

a nest means formed in a surface of said first flotation member;

a weight member loosely received within said nest means;

an elongate, flexible cord member having a first end secured to said reel member and a second end thereof secured to said weight member;

said cord member being coilable about said reel member;

means for allowing ejection of said weight member out of said nest means when the buoy is tossed into a body of water; and said means for allowing ejection being the loose fit between said weight member and said nest means;

whereby said weight member is thrown out of said nest means by a bobbing action when said buoy is tossed into a body of water.

2. The buoy of claim 1, wherein said first flotation member is hemispherical in configuration.

3. The buoy of claim 2, wherein said second flotation member is hemispherical in configuration.

4. The buoy of claim 3, wherein said nest means has a circular configuration and a predetermined depth.

5. The buoy of claim 4, wherein said weight member has a toroidal configuration and a predetermined thickness.

6. The buoy of claim 5, wherein the predetermined depth of said nest means is substantially equal to the predetermined thickness of said weight member.

7. The buoy of claim 6, further comprising a bore means formed in said first and second flotation members coincident with their respective longitudinal axes of symmetry.

8. The buoy of claim 7, wherein said means for maintaining said first and second flotation members in sandwiching relation to said reel member includes a rope member that extends through the center of said toroidal weight member and through the bore means formed in said first and second flotation members, said rope member having a first loop means formed at a first end thereof and having a second loop means formed at a second end thereof, said second loop means being sufficiently large to prevent its passing through said second bore means.

9. The buoy of claim 8, wherein said first loop is larger in extent than said second loop, is associated with said first flotation member, and provides a handle means for carrying and tossing said buoy.

10. The buoy of claim 9, further comprising a first counterweight member and a first cavity means formed in said first flotation member to receive said first counterweight member.

11. The buoy of claim 10, further comprising a second counterweight member and a second cavity means formed in said second flotation member to receive said second counterweight member.

12. The buoy of claim 11, further comprising a first dowel member of cylindrical configuration, said first dowel member being disposed in said bore means formed in said first flotation member and being axially received by said weight member, said first dowel member providing means for protecting said first flotation member from abrasion by said rope member and for protecting said rope member from abrasion by said weight member.

13. The buoy of claim 12, further comprising a second dowel member of cylindrical configuration, said second dowel member being disposed within the bore means formed in said second flotation member, said second dowel member protecting said second flotation member from abrasion by said rope member.

14. The buoy of claim 13, further comprising a cord clip member fixedly secured to said weight member, said second end of said cord member being fixedly secured to said cord clip member.

15. The buoy of claim 14, wherein said second loop of said rope member is a double loop.

16. A buoy, comprising:

a first flotation member of hemispherical configuration;

a first bore means formed in said first flotation member coincident with its longitudinal axis of symmetry;

a second flotation member of hemispherical configuration;

a second bore means formed in said second flotation member coincident with its longitudinal axis of symmetry;

a cylindrical in configuration reel member disposed in sandwiched relation to said first and second flotation members;

a toroidal in configuration weight member having a central opening and a predetermined thickness;

a circular nest means formed in a surface of said first flotation member for loosely receiving said weight member, said nest means having a depth equal to the predetermined thickness of said weight member;

a rope member extending through said first and second bore means formed in said first and second flotation members, respectively, and through the central opening of said weight member;

said rope member having a first and second end that extend beyond the respective ends of said first and second bore means;

a first loop means formed in said first end of said rope member;

a second loop means formed in said second end of said rope member;

said second loop means having a size sufficient to prevent its retraction into said second bore means; and an elongate cord member having a first end fixedly secured to said reel member, a medial part coilable about said reel member, and a second end fixedly secured to said weight member.

17. The buoy of claim 16, further comprising first and second cylindrical dowel members disposed in said first and second bore means, respectively, and said first dowel member also being axially received by the central opening formed in said weight member.

18. The buoy of claim 17, further comprising first and second cavity means formed in said first and second flotation members, and first and second counterweight members being fixedly received within said first and second cavity means, respectively.

19. The buoy of claim 18, wherein said second loop means is a double loop means.

20. The buoy of claim 19, wherein said first and second flotation members are formed of styrofoam.

21. A buoy, comprising:

a first part exhibiting a generally hemispherical configuration;

a second part exhibiting a generally hemispherical configuration;

a reel part exhibiting a generally cylindrical configuration and being disposed between said first and second parts;

said first, second and reel parts having a common longitudinal axis of symmetry;

said first, second and reel parts being formed of two separate halves that exhibit bilateral symmetry, said halves being separated from one another along a plane that passes through said longitudinal axis of symmetry of said buoy before assembly thereof;

a nest of predetermined configuration and dimension being formed in said first part when said halves are secured to one another;

a weight member being loosely disposed within said nest;

an elongate cord having a first end secured to said weight member and a second end secured to a preselected part of said buoy; and means for allowing ejection of said weight member from said nest when said buoy is tossed into a body of water;

said means including said loose disposition of said weight member in said nest and further including a bobbing action of said buoy in said body of water when said buoy is tossed thereinto.

22. The buoy of claim 21, further comprising a central bore formed in said buoy, coincident with the longitudinal axis of symmetry of said buoy.

23. The buoy of claim 22, wherein said central bore includes a first part having a first predetermined diameter and a second part of a second predetermined diameter, said second predetermined diameter being greater than said first predetermined diameter.

24. The buoy of claim 23, further comprising:

an elongate, flexible rope;

said rope having a return bend part formed mid-length thereof;

said rope having opposite ends thereof tied together;

a knot being formed by said tied together opposite ends; and a preselected part of said rope being positioned in said central bore;

said return bend part of said rope being disposed externally of said central bore so that said return bend part has utility as a handle for carrying said buoy.

25. The buoy of claim 24, wherein said knot has a predetermined diameter less then the second predetermined diameter of said central bore second part and greater than the first predetermined diameter of said central bore first part so that said knot can be disposed internally of said central bore second part when said buoy is carried by said rope and so that said knot is disposed externally of said central bore first part to thereby prevent said rope from slipping through said central bore when said buoy is being carried.

26. The buoy of claim 25, further comprising a groove being formed in an external surface of said buoy second part for snugly receiving an externally extending part of said rope therein when said buoy is not in use.

27. The buoy of claim 26, wherein said groove has a predetermined extent and wherein a medial part thereof passes through the longitudinal axis of symmetry of the buoy.

28. The buoy of claim 27, further comprising a plurality of alignment pins being formed on a first half of said buoy and a plurality of complementally formed and cooperatively positioned recesses being formed on a second half of said buoy, said pins being snugly received within associated recesses when said half parts are assembled to form said buoy.

29. The buoy of claim 28, wherein said elongate cord second end is positioned in said central bore in underlying relation to said rope when said buoy is assembled.

30. The buoy of claim 29, wherein said buoy is formed of molded plastic.

* * * * *